United States Patent [19]

Sörensen

[11] Patent Number: 5,046,916

[45] Date of Patent: Sep. 10, 1991

[54] HANDLING APPARATUS

[75] Inventor: Leif Sörensen, Olofstöm, Sweden

[73] Assignee: AB Volvo, Gothenburg, Sweden

[21] Appl. No.: 460,183

[22] PCT Filed: Sep. 16, 1988

[86] PCT No.: PCT/SE88/00472

§ 371 Date: Jan. 29, 1990

§ 102(e) Date: Jan. 29, 1990

[87] PCT Pub. No.: WO89/02348

PCT Pub. Date: Mar. 23, 1989

[30] Foreign Application Priority Data

Sep. 21, 1987 [SE] Sweden ..... 8703629

[51] Int. Cl.[5] ..... B65G 35/00

[52] U.S. Cl. ..... 414/751; 414/758; 414/773; 294/86.41; 198/403; 901/6

[58] Field of Search ..... 414/749, 751, 773, 758, 414/680, 729; 901/6; 198/403, 409, 412; 294/119.1, 86.4

[56] References Cited

U.S. PATENT DOCUMENTS

| | | | |
|---|---|---|---|
| 3,973,673 | 8/1976 | Ahluwalia | 198/403 X |
| 4,493,450 | 1/1985 | Yuzui | 198/403 X |
| 4,636,131 | 1/1987 | Sinclair | 414/751 X |
| 4,648,786 | 3/1987 | Sakurai . | |
| 4,921,387 | 5/1990 | Bennington | 414/751 X |

FOREIGN PATENT DOCUMENTS

| | | |
|---|---|---|
| 852039 | 10/1952 | Fed. Rep. of Germany . |
| 3436576 | 4/1986 | Fed. Rep. of Germany . |
| 419958 | 9/1981 | Sweden . |
| 434234 | 7/1984 | Sweden . |
| 452753 | 12/1987 | Sweden . |

*Primary Examiner*—Robert J. Spar
*Assistant Examiner*—Donald W. Underwood
*Attorney, Agent, or Firm*—Young & Thompson

[57] ABSTRACT

Apparatus for transporting and handling piece goods (4), containing a stand; a transport rail (10) carried by the stand; a trolley (17) which can be moved along the rail (10) by a separate drive (19); and a gripping device (22) which is pivotally mounted on the trolley and contains structure to hold the piece goods (4). A rotatably journalled guide shaft (28) of non-round cross-section extends substantially parallel with the transport rail (10); and a follower (30, 31) is rotatably arranged on the trolley (17) and connected to the guide shaft (28) so as to be slidable therealong but torsionally rigid in a radial direction. The guide shaft (28) is rotated by a motor (29); and an angular rotation transmission (23-27) converts rotation of the guide shaft (28) to swinging movement of the gripping device (22).

4 Claims, 6 Drawing Sheets

HANDLING APPARATUS

This invention relates to apparatus for handling piece goods, such as pressed sheet-metal elements for instance, and intended to be positioned, e.g., between two presses in a line of presses and there to transport or shuttle said goods singly from one press to the next press in line.

Press lines in which sheet-metal elements or items are pressed, for instance in the car manufacturing industry, incorporate various kinds of transporting and handling apparatus constructed for transferring the elements from one press to the next press in line. Such apparatus is normally placed on the floor between respective presses, which means that this area of the floor occupied by the apparatus is blocked. This can cause difficulties when changing tools in respective presses and also when carrying out other forms of maintenance work. There is also a risk that the apparatus will be damaged by auxiliary material handling equipment active in the vicinity of said apparatus, e.g. trucks or rail systems.

The object of the present invention is to provide transporting and handling apparatus which will avoid these drawbacks and leave the floor space between the presses completely free for the exchange of tools and for carrying out other maintenance work, while at the same time removing the risk of damage to the equipment by the aforesaid auxiliary transporting devices. This object is achieved by means of transporting and handling apparatus having the features set forth hereinafter.

The invention will now be described in more detail with reference to the accompanying drawings, in which FIG. 1 is a perspective view of one embodiment of the inventive apparatus arranged between two presses;

Figure 1:
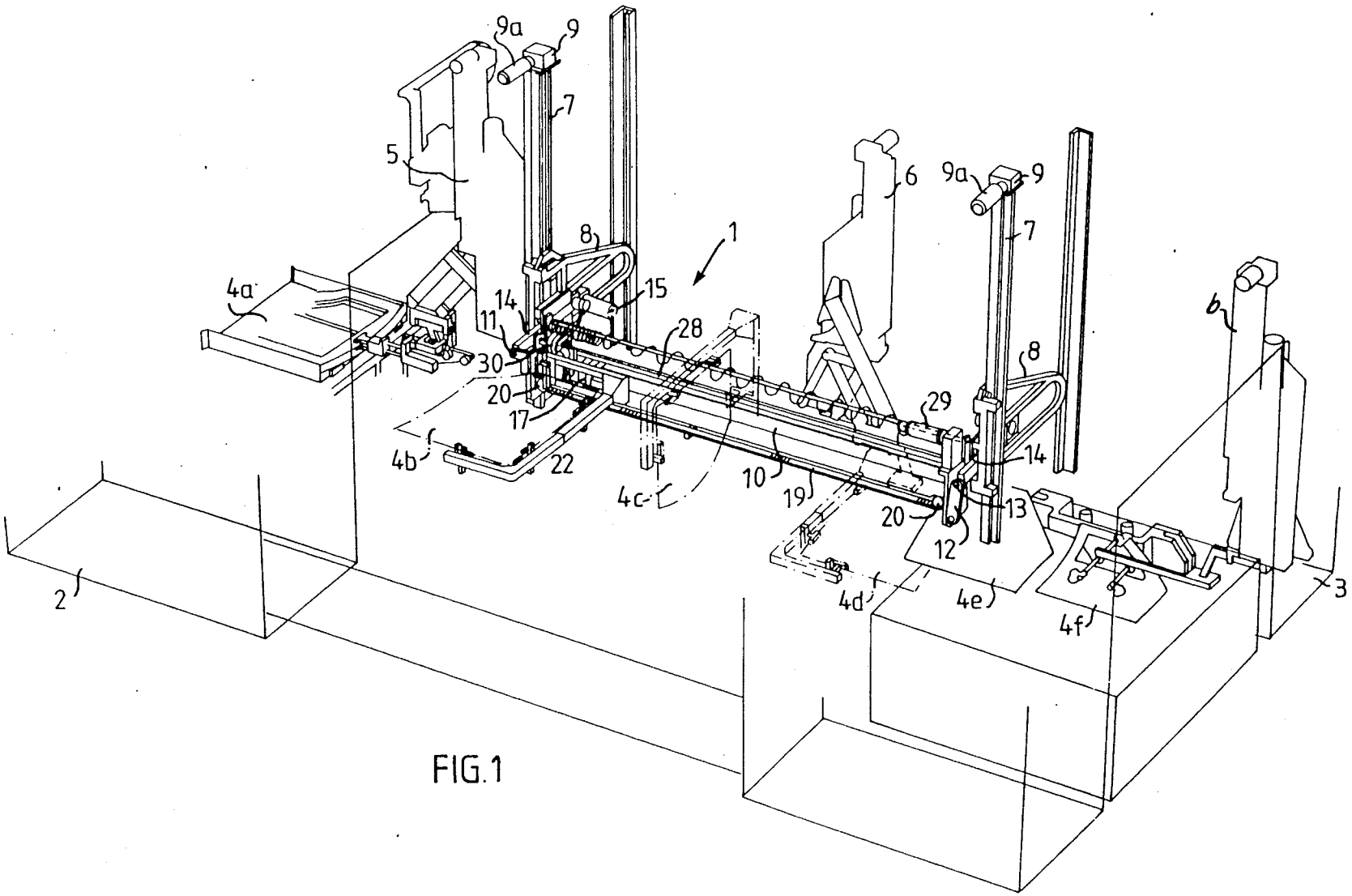
Figure 2:
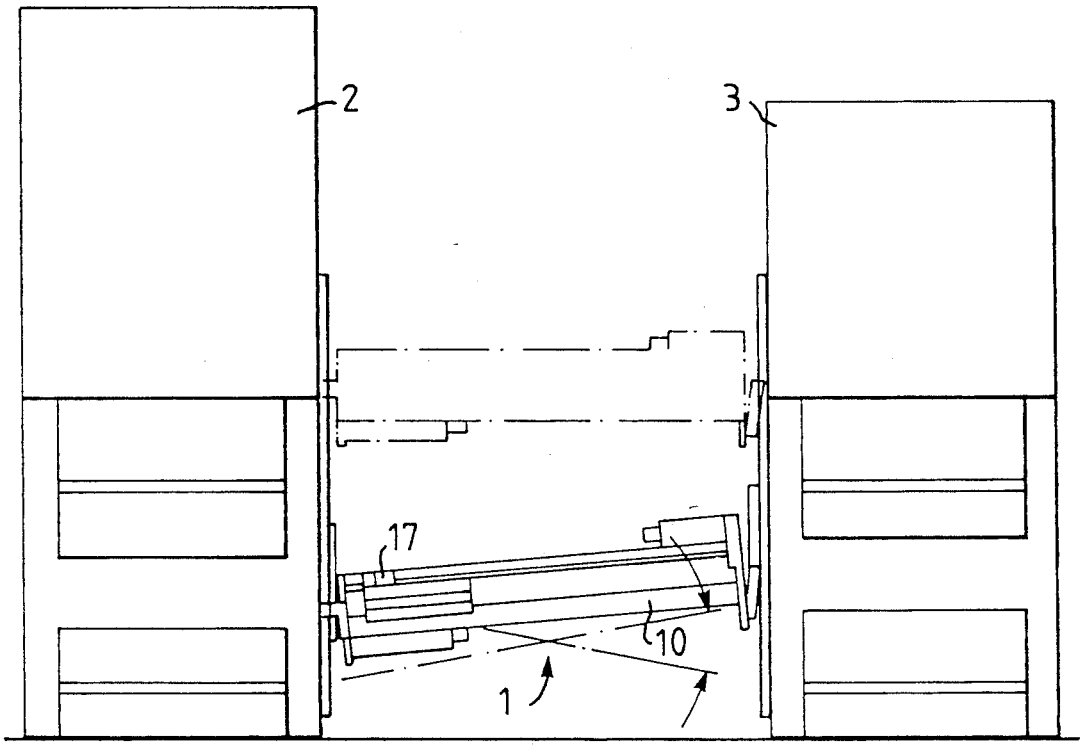
FIG. 2 is a simplified side view of the apparatus illustrated in FIG. 1.

In the FIG. 1 illustration, the inventive transporting and handling apparatus 1 is placed between two presses 2 and 3 which form part of a line of presses intended for the manufacture of sheet-metal elements 4. FIG. 1 shows sheet-metal elements 4*a–f* in their various positions during transfer from the press 2 to the press 3. In the illustrated case, each element 4 is removed from the press 2 with the aid of a feeder 5 (not shown in detail) which transfers respective elements to the apparatus 1. The element 4 is then moved by the apparatus 1 to the press 3, where a feeder 6 moves the elements into the press.

The inventive apparatus includes two vertical, hollow guides 7 mounted on respective presses 2 and 3. Each guide 7 is intended to carry a height adjustment slide 8 which can be moved vertically along its respective guides 7 with the aid of a lifting device 9, e.g. a nut and spindle type jack, mounted within the hollow guide 7 and dimensioned for lifting the whole of the handling apparatus 1. Each jack 9 is provided with its separate motor 9*a*, which is fitted with a pulse emitter in order to enable the jack to be controlled to a desired position.

Extending between the height adjustment slides 8 is a transport rail 10. As seen in FIG. 1, the left-hand end of the rail 10 is suspended by means of a pivot bearing 11 which affords direct connection between the slide 8 and the rail 10, whereas the right-hand end of the rail is connected to the slide 8 by means of an intermediate link arm 12 and a pivot bearing 13. The pivot bearings 11 and 13 are, in turn, each mounted on a respective lateral adjustment slide 14 arranged for linear displacement in the slides 8.

Each lateral adjustment slide 14 is provided with a separate drive motor 15, which in turn is provided with a pulse emitter for enabling the slide to be controlled to the position desired.

Figure 3:
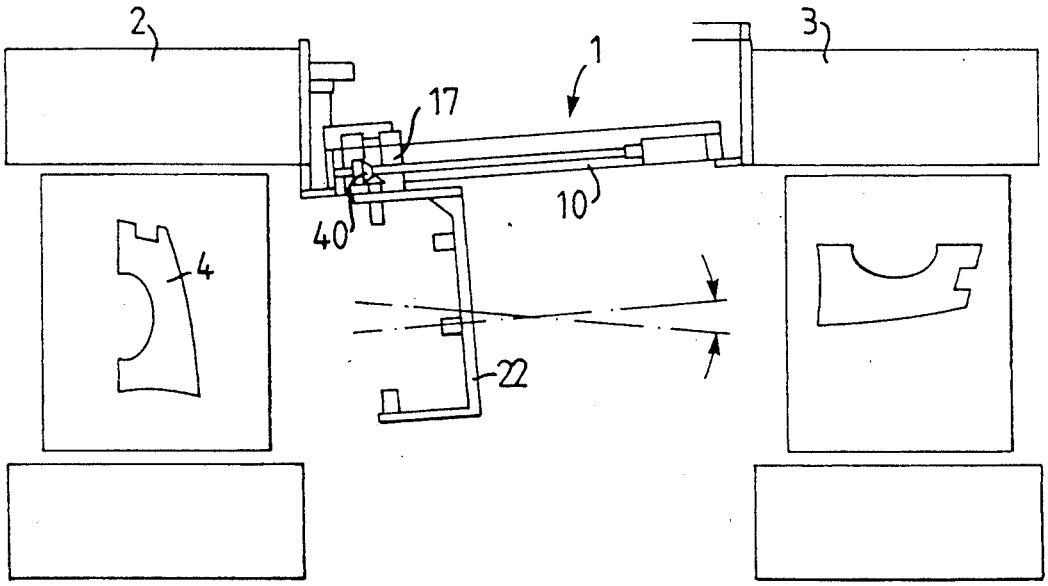
FIG. 3 is a view from above of the apparatus in FIG. 2.

The rail 10 can be positioned obliquely, or tilted, about its longitudinal axis, by displacing the lateral adjustment slides 14 to mutually different extents in the two ends of the rail 10, as illustrated more clearly in FIG. 3. This enables the element 4 to be moved laterally during shuttling of said elements from the press 2 to the press 3. The intermediate link arm 12 and the respective pivot bearings 11, 13 enable the differences in the length and the oblique position of the transport rail 10 to be taken-up.

Figure 4:
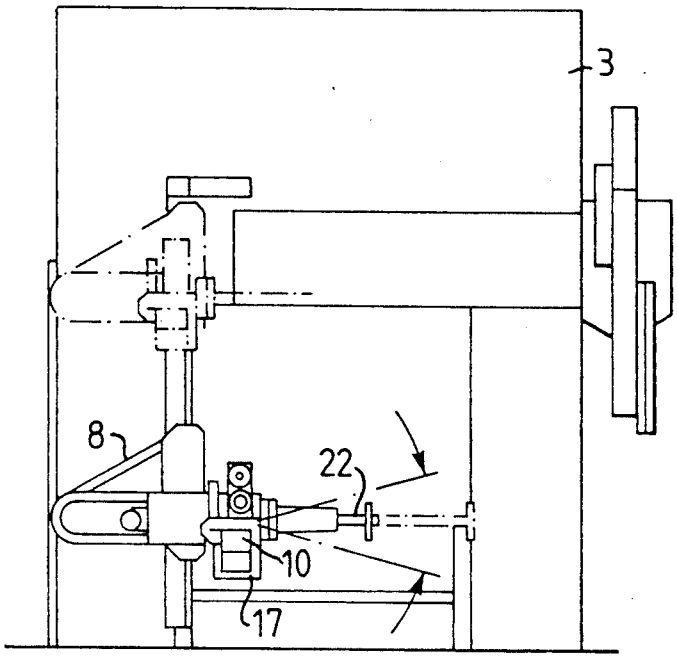
FIG. 4 is an end view of the apparatus illustrated in FIGS. 2 and 3.
Figure 5:
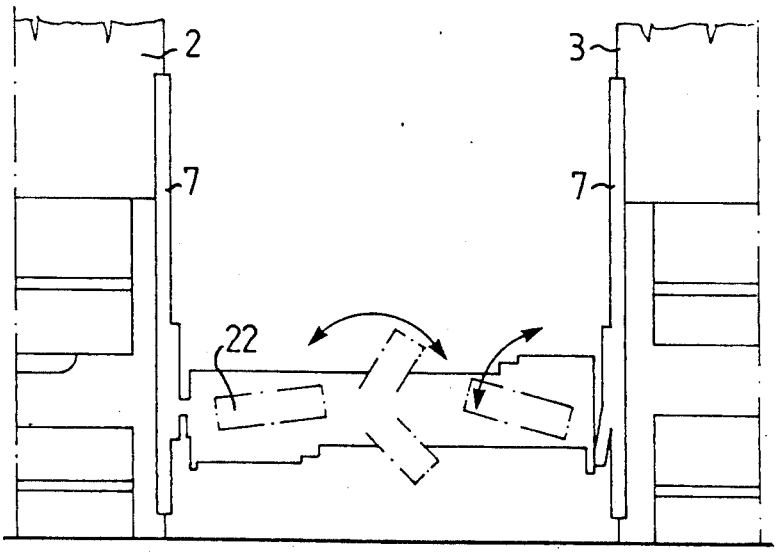
FIG. 5 is a side view similar to that of FIG. 2, but illustrating the pattern of movement carried out by certain apparatus components.

The bearings 11 and 13 also enable the rail 10 to be rotated about an axis which is parallel to the longitudinal axis of the rail 10. This rail setting is illustrated in FIG. 4 and is accomplished with the aid of drive motor (not shown) having a pulse emitter, which enables the rail to be adjusted to a desired setting.

Figure 6:
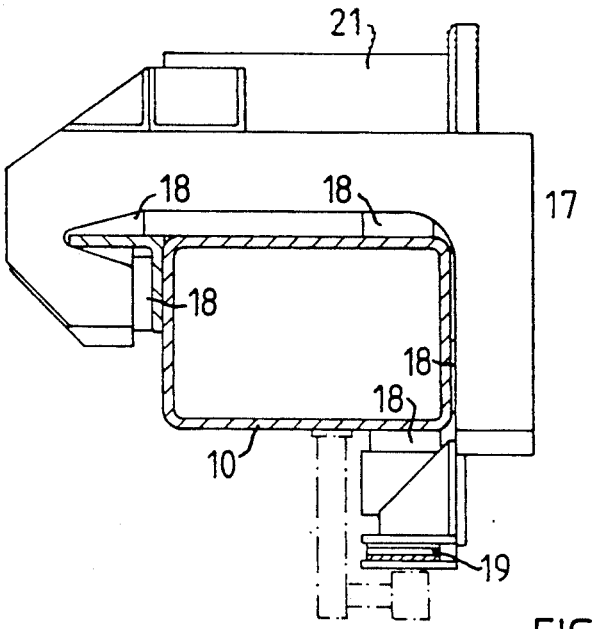
FIG. 6 is an end view of a trolley forming part of the inventive handling apparatus.

Arranged on the rail 10 for movement therealong is a trolley 17, which is best seen from FIG. 6. The trolley 17 rests on the rail 10 through the intermediary of rollers or runners 18 which engage respective sides of the rail 10 such as to take-up forces acting on the trolley 17. The trolley 17 is moved along the rail 10 with the aid of a toothed belt 19 which is attached to the trolley and extends over guide rollers 20 located at respective ends of the rail. The belt is driven by a drive motor (not shown) which is provided with a pulse counter so as to enable the position of the trolley 17 along the rail 10 to be controlled.

The trolley 17 is provided with an attachment means 21 which carries a pivotal gripping device 22. This device 22 functions to hold the elements 4 as they are handled in the apparatus 1. Accordingly, the gripping device 22 is adapted to the shape and size of the element 4 to be handled by the apparatus, and the device is also preferably adjustable with regard to size, so that it can be adapted to elements 4 of mutually different sizes.

Figure 7:
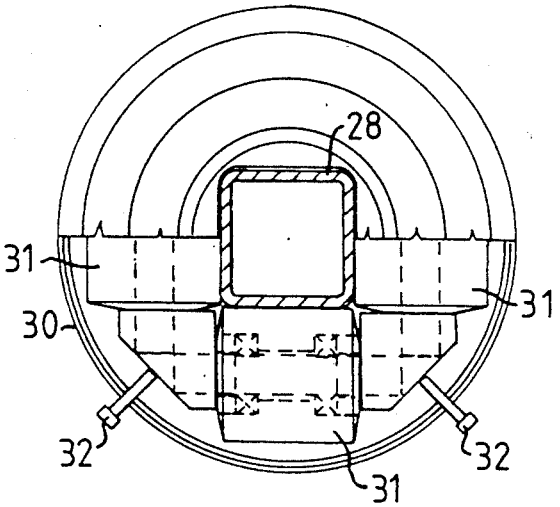
FIG. 7 is a partially cut-away end view of part of a movement transmission means forming part of the apparatus.
Figure 8:
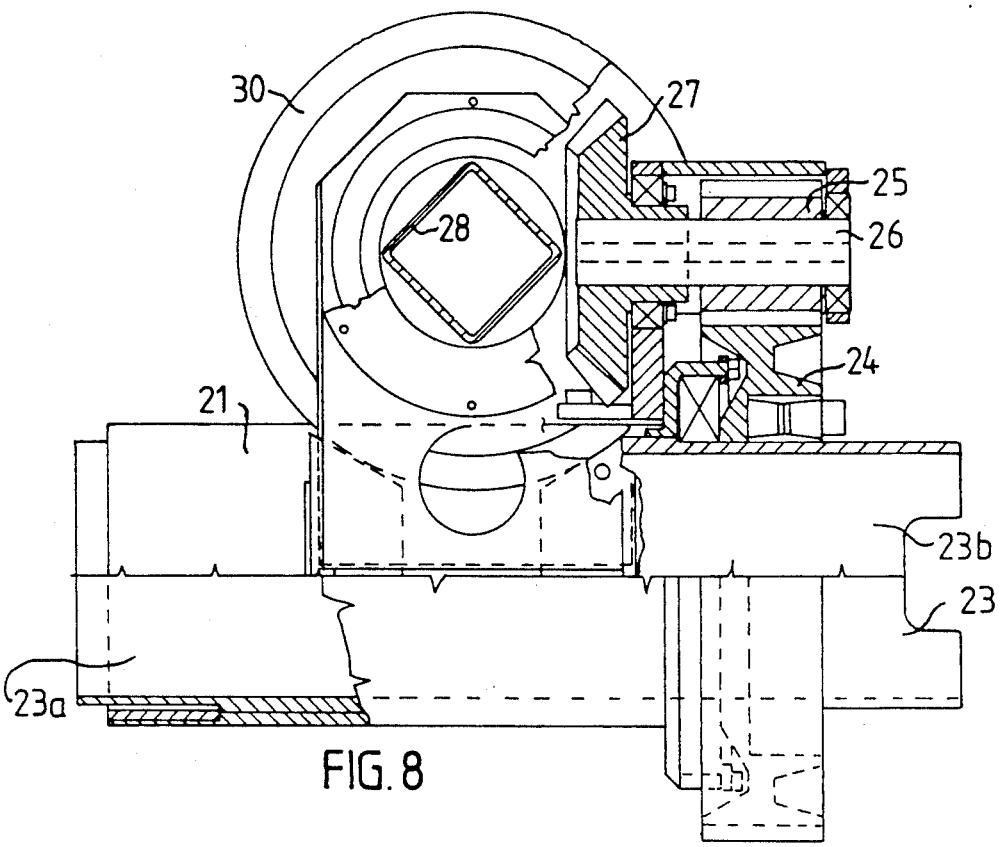
FIG. 8 is a partly cut-away view of said movement transmission means.

The connection between the trolley 17 and the gripping device 22, and the possibilities of rotating the gripping device 22 in the attachment means 21 are shown more clearly in FIGS. 7 and 8. As will be seen from FIG. 8 in particular, a hollow shaft 23 is rotatably journalled in the attachment 21 on the trolley 17. The gripping device 22 is attached to the right-hand end of the hollow shaft 23 in FIG. 8. The hollow shaft 23 carries a gear wheel 24 which engages a gear wheel 25 rigidly mounted on an axle 26, this axle 26 being journalled on the trolley 17 and carrying a bevel gear wheel 27. Rotation of the bevel wheel 27 will result in rotation of the hollow shaft 23, via the gear wheels 25, 24, and therewith also in the rotation of the gripping device.

The bevel gear wheel 27 is rotated by a guide shaft 28 which is located above the transport rail 10 and journalled at the ends thereof, and which is driven by a drive motor 29 (see FIG. 1). The drive motor 29 is, in turn, provided with a pulse counter which enables the guide shaft 28 to be controlled, and therewith also the position of the gripping device 22. The guide shaft 28 has a non-round cross-section, in the case of the illustrated embodiment a square cross-section, and passes through a follower in the form of a housing 30 which accommodates rollers 31 intended to run against a respective side of the guide shaft 28. The axles of the rollers 31 can be adjusted with the aid of setting screws 32, in a manner such that the rollers 31 will run on the shaft 28 substantially in the absence of any play therebetween. When the guide shaft 28 is rotated, the rollers 31 will also rotate and thereby turn a bevel gear wheel 40 which engages or meshes with the bevel gear wheel 27. Consequently, rotation of the guide shaft 28 will result in rotation of the gripping device 22.

The guide shaft 28 and the mechanism for transmitting movement to the gripping device 22 are used to enable the elements 4 to be turned during their transfer from the press 2 to the press 3. This is illustrated in chain lines in FIG. 1. As illustrated in the FIGURE, the element 4 is turned first to the position 4*e*, in which the element is essentially vertical, and then to position 4*d*, in which the element has been turned through an angle of 180° from its original position 4*b*. The element is then ready to be introduced into the press by the feeder 6, as indicated at position 4*e*.

Figure 9:
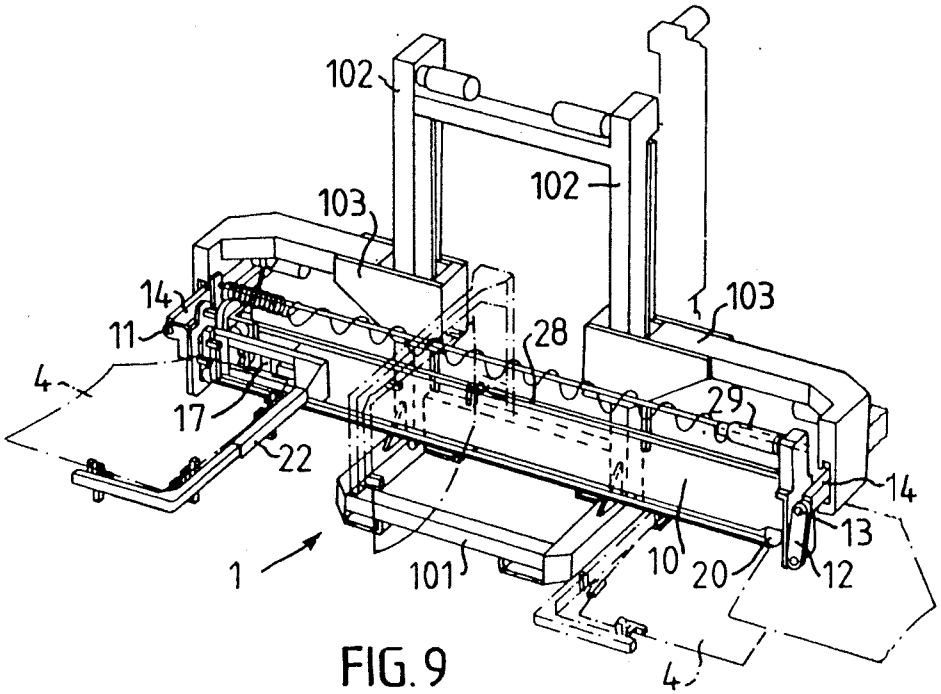
FIG. 9 is a perspective view of another embodiment of the inventive handling apparatus.

FIG. 9 illustrates another embodiment of the inventive handling apparatus. This alternative embodiment has many components which are similar to the embodiment previously described and which have been identified in FIG. 9 with the aid of the same reference numerals as those used earlier. Consequently, only those parts of the apparatus which differ from the FIG. 1 embodiment will be described in the following.

In the case of the embodiment illustrated in FIG. 9, the apparatus 1 is mounted in a floor stand 101 having two vertical guides 102. Height adjustment slides 103 are arranged for movement along the guide 102 and can be moved vertically with the aid of jacks provided in the hollow guides 102. The slides 103 have the form of arms which project from the guides 102 and which carry at their respective ends lateral adjustment slides 14.

Although the apparatus illustrated in FIG. 9 will afford most of the advantages afforded by the previously described embodiment, the floor stand 101 encroaches somewhat on the floor space on one side of the press line.

Figure 10:
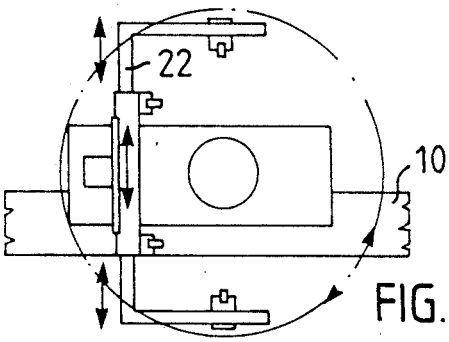
FIGS. 10–12 illustrate the pattern of movement carried out by a gripping device forming part of the inventive apparatus.
Figure 11:
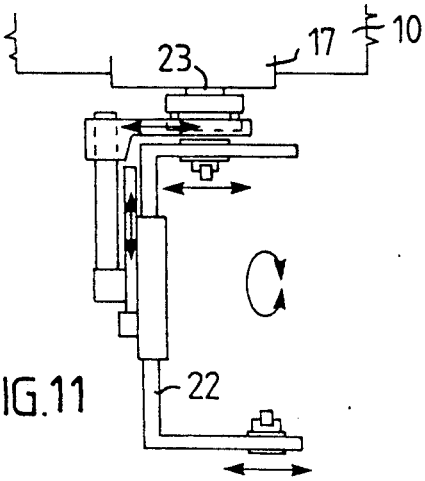
Figure 12:
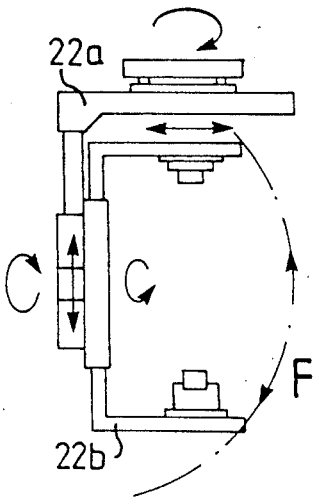

FIGS. 10, 11 and 12 illustrate schematically the various patterns of movement carried out by the gripping device 22. In the case of the embodiment illustrated in FIGS. 10, 11 and 12, the gripping device 22 is substantially U-shaped and is attached to the hollow shaft 23 through one leg of the U. The hollow shaft 23 is provided with open ends 23*a* and 23*b* through which there extend the control lines of gripping members intended for gripping the element 4 in the gripping device 22. These gripping members are of a kind known per se and may comprise, for instance, two mutually parallel and mutually facing clamp devices arranged in adjacent, slightly overlapping relationship, e.g. pneumatic clamp devices sold under the trade name Tünkers KG, type PKS. In distinction to the gripping device 22 of the embodiments illustrated in FIGS. 1 and 9, the gripping device illustrated in FIGS. 10, 11 and 12 has a L-shaped part 22*a*, one leg of which is attached to the hollow shaft 23, and a pivotal U-shaped part 22*b* which is pivotally attached to the other leg of the L-shaped part 22. In addition to enabling the element 4 to be turned in the manner described with reference ti FIG. 1, this latter embodiment of the gripping device will also enable the element 4 to be turned in a plane which extends at right angles to the plane in which the first mentioned turn was effected.

I claim:

1. In apparatus for transporting and handling piece goods (4), comprising a stand; a transport rail (10) carried by said stand; a trolley (17) which can be moved along the rail (10) by means of a separate drive means (19); and a gripping device (22) which is pivotally mounted on the trolley and adapted to hold said piece goods (4); the improvement comprising a rotatably journalled guide shaft (28) of non-round cross-section which extends substantially the length of and parallel with the transport rail (10); a follower (30, 31) which is rotatably arranged on the trolley (17) and connected to the guide shaft (28) so as to be slideable therealong but torsionally rigid in a radial direction; means (29) to rotate said guide shaft (28); and an angular rotation transmission means (23–27, 40) converting rotation of said guide shaft (28) to swinging movement of said gripping device (22).

2. Apparatus according to claim 1, wherein said stand includes at least two substantially vertical guides (7; 102) located at respective ends of the transport rail (10); and each guide carries a slide (8; 103) which can be driven separately along its associated guide and which is pivotally coupled to a respective end of the transport rail (10).

3. Apparatus according to claim 2, wherein the ends of the transport rail (10) are each pivotally connected to a respective lateral adjustment slide (14) which are individually movable substantially in the horizontal direction and which, in turn, are each arranged on a respective one of the vertically movable height adjustment slides (8; 103).

4. Apparatus according to claim 1, wherein the guide shaft (28) has a substantially rectangular cross-section with planar surfaces; and the follower connected to the guide shaft incorporates a holder means (30) and four rollers (31) journalled in the holder means, each of said rollers being adapted to abut a respective planar surface of said guide shaft (28).

* * * * *